US008967975B2

(12) United States Patent
Abastari et al.

(10) Patent No.: US 8,967,975 B2
(45) Date of Patent: Mar. 3, 2015

(54) CENTRIFUGAL AIR BLOWER AND AIR CONDITIONER

(75) Inventors: Abastari, Oura-gun (JP); Takayuki Masukawa, Ota (JP); Takahiro Nakamura, Kumagaya (JP)

(73) Assignee: Panasonic Intellectual Property Management Co., Ltd., Osaka-shi (JP)

( * ) Notice: Subject to any disclaimer, the term of this patent is extended or adjusted under 35 U.S.C. 154(b) by 769 days.

(21) Appl. No.: 13/147,132

(22) PCT Filed: Jan. 26, 2010

(86) PCT No.: PCT/JP2010/000435

§ 371 (c)(1),
(2), (4) Date: Jul. 29, 2011

(87) PCT Pub. No.: WO2010/087152

PCT Pub. Date: Aug. 5, 2010

(65) Prior Publication Data

US 2011/0284190 A1 Nov. 24, 2011

(30) Foreign Application Priority Data

Jan. 30, 2009 (JP) ..... 2009-020130
Apr. 28, 2009 (JP) ..... 2009-109555

(51) Int. Cl.
*F01D 5/22* (2006.01)
*F04D 29/28* (2006.01)

(52) U.S. Cl.
CPC ..... *F04D 29/28* (2013.01); *F04D 29/281* (2013.01)
USPC ..... 416/196 R

(58) Field of Classification Search
USPC ..... 415/175, 206; 416/182, 185, 186 R, 416/196 R
See application file for complete search history.

(56) References Cited

U.S. PATENT DOCUMENTS 4,526,506 A * 7/1985 Koger et al. ..... 415/98
6,695,584 B2 * 2/2004 Kim et al. ..... 416/186 R
7,281,898 B2 * 10/2007 Baek et al. ..... 416/186 R (Continued)

FOREIGN PATENT DOCUMENTS

JP 06-101696 A 4/1994
JP 07-293494 A 11/1995

(Continued)

OTHER PUBLICATIONS

International Search Report of PCT/JP2010/000435, date of mailing Apr. 13, 2010.

(Continued)

*Primary Examiner* — Edward Look
*Assistant Examiner* — Aaron R Eastman
(74) *Attorney, Agent, or Firm* — Westerman, Hattori, Daniels & Adrian, LLP

(57) ABSTRACT

There is provided a centrifugal air blower that can reduce driving force (consumed driving force) when an air blower is rotated, and also increase an airflow amount of air to be blown out from the air blower. A centrifugal air blower having an impeller 1 comprising a main plate 3 and plural vanes 2, and a side plate having a suction port and a blow-out port is characterized in that when the height of the suction port is represented by H, the height of the blow-out port is represented by h, the diameter of the impeller is represented by D and the diameter of the suction port is represented by d, $0.5<h/H<0.8$ and $0.78<d/D<0.84$ are satisfied.

5 Claims, 10 Drawing Sheets

(56) References Cited

U.S. PATENT DOCUMENTS

| | | | | |
|---|---|---|---|---|
| 2002/0021967 | A1* | 2/2002 | Kim et al. | 416/186 R |
| 2002/0110455 | A1* | 8/2002 | Kim et al. | 416/196 R |
| 2002/0131861 | A1* | 9/2002 | Sakai et al. | 415/204 |
| 2003/0044280 | A1* | 3/2003 | Kim et al. | 416/186 R |
| 2003/0147745 | A1* | 8/2003 | Canali et al. | 415/206 |
| 2003/0235496 | A1* | 12/2003 | Eaton et al. | 415/206 |

FOREIGN PATENT DOCUMENTS

| | | | |
|---|---|---|---|
| JP | 2002-061597 | A | 2/2002 |
| JP | 2004-506141 | A | 2/2004 |
| JP | 3105873 | U | 12/2004 |
| JP | 2007-154685 | A | 6/2007 |
| JP | 2008-121589 | A | 5/2008 |
| WO | 02/12729 | A1 | 2/2002 |

OTHER PUBLICATIONS

Notification of Transmittal of Translation of the International Preliminary Report on Patentability (Form PCT/IB/338) of International Application No. PCT/JP2010/000435 mailed Aug. 18, 2011 with Forms PCT/IB/373, PCT/ISA/237 and PCT/IB/326.

Canadian Office Action dated Feb. 4, 2013, issued in corresponding Canadian Patent Application No. 2750090.

Office Action dated Jul. 1, 2013, in corresponding to Chinese Application No. 201080006036.0 w/English Translation. (15 pages).

Chinese Office Action dated Feb. 28, 2014, issued in corresponding Chinese Patent Application No. 201080006036.0 with English translation (15 pages).

* cited by examiner

CENTRIFUGAL AIR BLOWER AND AIR CONDITIONER

TECHNICAL FIELD

The present invention relates to a centrifugal air blower used for an air conditioner or the like, and an air conditioner having the air blower.

BACKGROUND ART

In general, a centrifugal air blower has been broadly used as an air blower, for an air conditioner or the like, and recently requirements for high performance and reduction of noises have been particularly remarkably stronger, so that a method of enhancing the performance by improving the shape of an impeller (for example, see Patent Document 1).

PRIOR ART DOCUMENT

Patent Document

Patent Document 1: JP-A-Hei-6-101696

SUMMARY OF THE INVENTION

Problem to be Solved by the Invention

However, it has been recently required to enhance the airflow amount of an air blower and reduce the driving force (motor load) from the viewpoint of energy saving.

Therefore, an object of the present invention is to solve the problem of the above conventional technique, and provide a centrifugal air blower that can reduce driving force of an air blower.

Means of solving the Problem

In order to attain the above object, a centrifugal air blower having an impeller comprising a main plate and a plurality of vanes, and a side plate having a suction port and a blow-out port, is characterized in that when the height of the suction port is represented by H, the height of the blow-out port is represented by h, the diameter of the impeller is represented by D and the diameter of the suction port is represented by d, $0.5<h/H<0.8$ and $0.78<d/D<0.84$ are satisfied.

In this case, the diameter D of the impeller and the diameter d of the suction port may satisfy $0.80<d/D<0.83$.

According to the simulation, it has been found that both the enhancement of the airflow amount (Q)$m^3/s$ and the reduction of the motor load Watt can be simultaneously satisfied when $0.5<h/H<0.8$ and $0.78<d/D<0.84$ are satisfied. Further preferably, it has been found that the motor load Watt can be further reduced when the air blower is designed under the condition of $h/H=0.65$ and $0.80<d/D<0.83$.

The angle of the suction portion may be substantially equal to 90.

The radius of curvature R1 of the first curved line portion of the side plate may satisfy 20 mm<R1<27 mm, and the radius of curvature R2 of the second curved line portion of the side plate may satisfy 85 mm<R2<110 mm, and preferably 90 mm<R2<105 mm.

According to the simulation, it has been found that both the enhancement of the airflow amount (Q)$m^3/s$ and the reduction of the motor load Watt can be simultaneously satisfied when the angle of the suction portion is made to approach to 90, the radius of curvature R1 of the first curved line portion is set to 20 mm<R1<27 mm, and the radius of curvature R2 of the second curved line portion is set to 85 mm<R2<110 mm, preferably 90 mm<R2<105 mm.

Effect of the Invention

According to this invention, both the enhancement of the airflow amount (Q)$^{3}/s$ and the reduction of the motor load Watt can be simultaneously satisfied by designing the air blower under the condition of $0.5<h/H<0.8$ and $0.78<d/D<0.84$.

MODE FOR CARRYING OUT THE INVENTION

An embodiment according to the present invention will be described with reference to the drawings.

Figure 1:
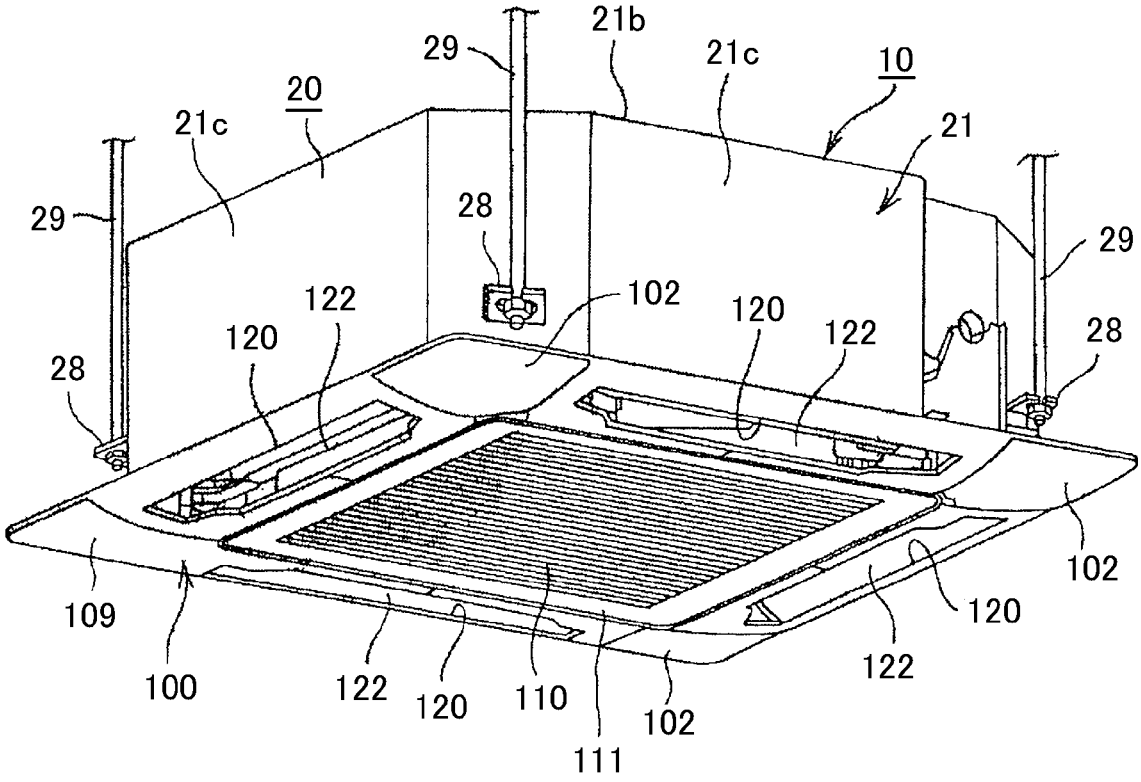
[FIG. 1] is a perspective view showing an apparatus main body of an indoor unit.

FIG. 1 is a diagram showing an installation state of an indoor unit of an in-ceiling embedded type air conditioner according to an embodiment. In the following description, the directions of up, down, right, left, etc. mean those directions corresponding to the installation state.

This indoor unit 10 is constructed as a so-called ceiling cassette type in which an apparatus main body 20 (housing 21) is installed under the roof and a face panel 100 is exposed from the ceiling, and more accurately it is constructed as a four-way ceiling cassette type having four air blow-out ports 120.

The apparatus main body 20 has a metal housing 21 constituting an outer case thereof, and air-conditioning parts such as a centrifugal air blower 33 (see FIG. 2), a heat exchanger (indoor heat exchanger), etc. are mounted in the housing 21. The housing 21 is formed by sheet metal processing of a metal plate, and it has a top plate portion (top plate) 21*b* and a side plate portion (side plate) 21*c* extending downwardly along the outer edge of the top plate portion 21*b* and is designed in a box-like shape so that the overall lower surface thereof is opened.

Hanging clasps 28 for hanging the apparatus main body 20 are provided at four corner portions on the outer surface of the side plate portion 21*c* of the housing 21. The hanging clasps 28 are secured to hanging bolts 29 under the roof so that the apparatus main body 20 is supported and hung. The apparatus main body 20 may be fixed to holding bars which are provided to the ceiling surface in a grid shape.

A face panel 100 is secured to the lower portion of the apparatus main body 20, that is, the lower portion of the housing 21. This face panel 100 is formed of a resin panel, and it is designed in a rectangular shape larger than the opening of the lower side of the housing 21. The face panel 100 has one air suction port 110 for taking indoor air at the center portion thereof, and plural (four in this embodiment) air blow-out ports 120 which extend along the four sides of the face panel 100 around the suction port 110 and through which heat-exchanged air is blown out.

A suction grille 111 is freely detachably mounted at the air suction port 110 of the face panel 100, an air filter (not shown) is mounted at the suction grille 111, and indoor air sucked into the air suction port 110 is cleaned by the air filter. Louvers 122 for changing the air flowing direction are arranged at the air blow-out ports 120 of the face panel 100, and the louvers 122 are turned by the driving of motors (not shown).

Corner panels 102 are secured to the four corner portions of the face panel 100. The corner panels 102 are configured to be detachable to the lower side of the face panel 100, and have such a size so as to grant a worker access to the engaging position of the hanging clasp 28 and the hanging bolt 29 when a corner panels 102 is detached.

Figure 2:
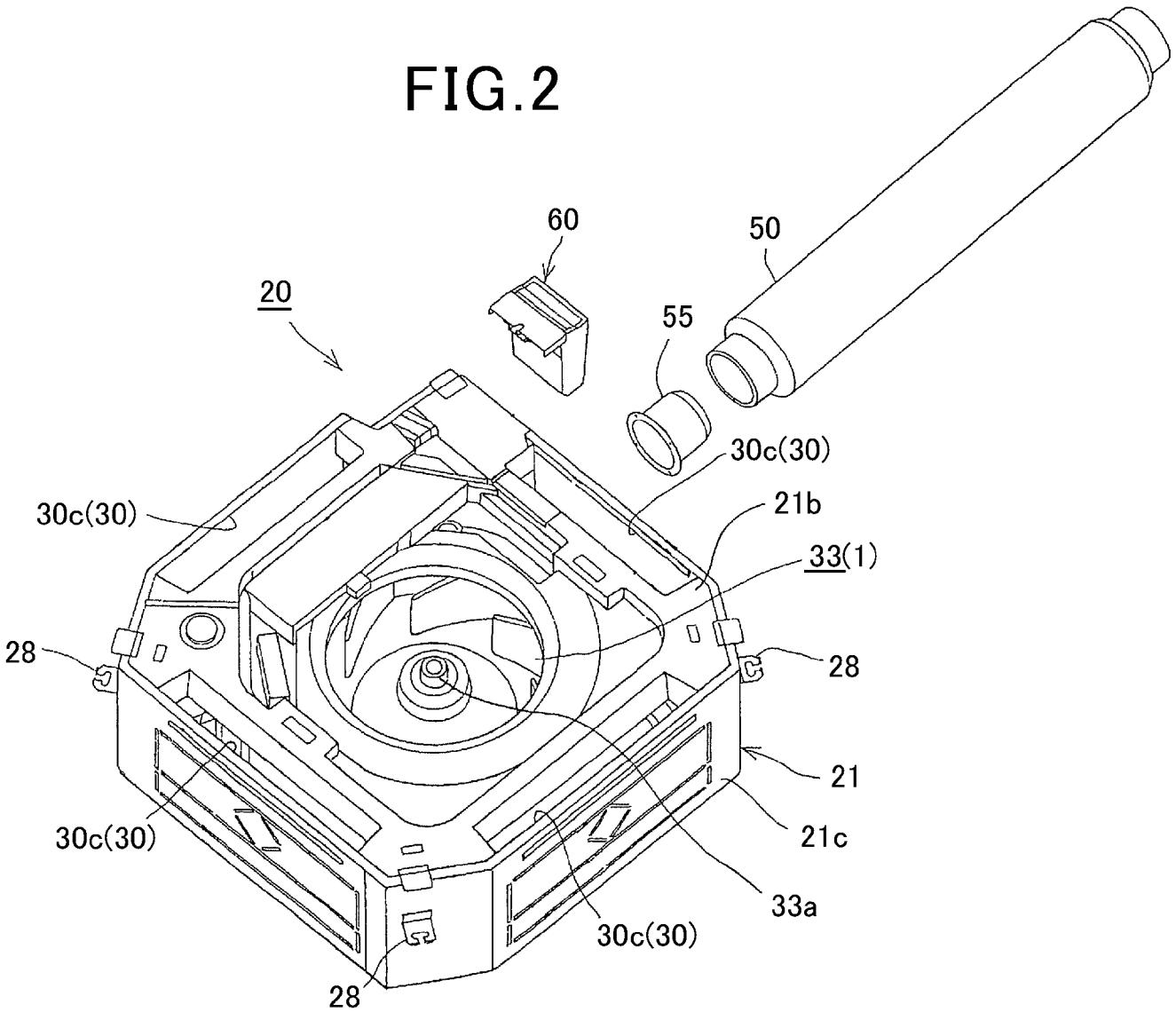
[FIG. 2] is a plan view when the apparatus main body is viewed from the lower side.

FIG. 2 is a perspective view showing the apparatus main body 20 of the indoor unit 10, and it is illustrated together with an outdoor air introducing part which is prepared as an option by a maker in consideration of such a situation that the indoor unit 10 is installed at a place to which a building management law for high-rise floors of buildings, etc. is applied. Reference numeral 50 represents a ventilation duct for introducing outside air, reference numeral 55 represents a duct joint part for joining the ventilation duct 50 to the housing 21 of the indoor unit 10, and reference numeral 60 represents an outdoor air introducing box (outdoor air introducing part) secured in the housing 21 of the indoor unit 10.

A heat insulating member 30 formed of foam polystyrene is disposed inside the housing 21. This heat insulating member 30 is equipped with a top plate heat insulating portion disposed substantially over the whole surface of the top plate portion (top plate) 21*b* of the housing 21, and a side plate heat insulating portion 30*c* disposed substantially over the whole surface of the side plate portion 21*c* of the housing 21 which are provided integrally with each other, and designed in a box-like shape which is opened at the lower side thereof. That is, this heat insulating member 30 is covered on the overall inner surface of the housing 21 to insulate heat between the inside and outside of the housing 21, thereby establishing a heat insulating structure, and air conditioning parts such as the centrifugal air blower 33, the heat exchanger, etc. are mounted in the thus heat-insulated inner space.

As shown in FIG. 2, the centrifugal air blower 33 comprises a fan motor 33*a* which is provided substantially at the center of the housing 21 (the position corresponding to the center portion of the top plate portion 21*b*) and secured to the top plate portion 21*b* of the housing 21 with the motor shaft thereof being oriented to the lower side, and an impeller 1 secured to the motor shaft of the fan motor 33*a*. Air in a room to be air-conditioned (indoor air) is sucked from the air suction port 110 of the face panel 100 by rotation of the impeller 1, and blown out in the centrifugal direction.

Figure 3:
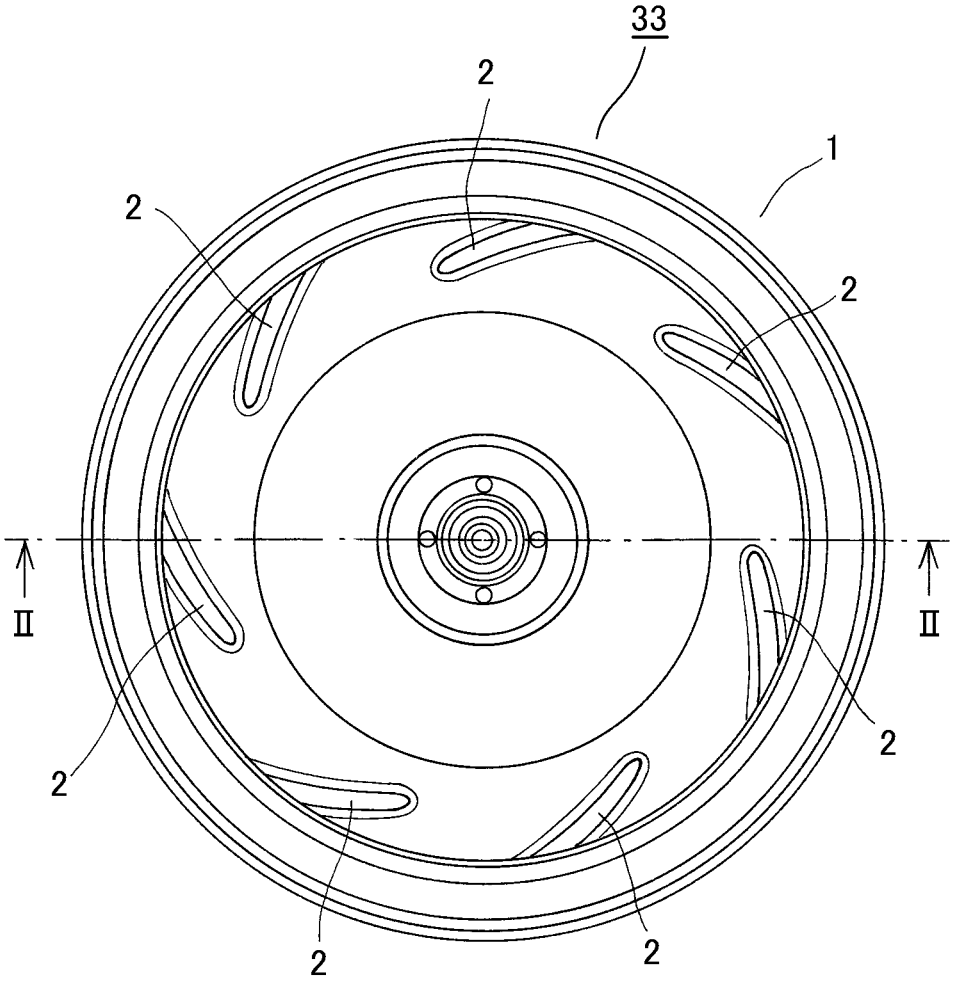
[FIG. 3] is a top view of a centrifugal air blower according to an embodiment of the present invention.

FIG. 3 is a top view of the centrifugal air blower 33, and FIG. is a cross-sectional view of II-II of FIG. 3.

Figure 4:
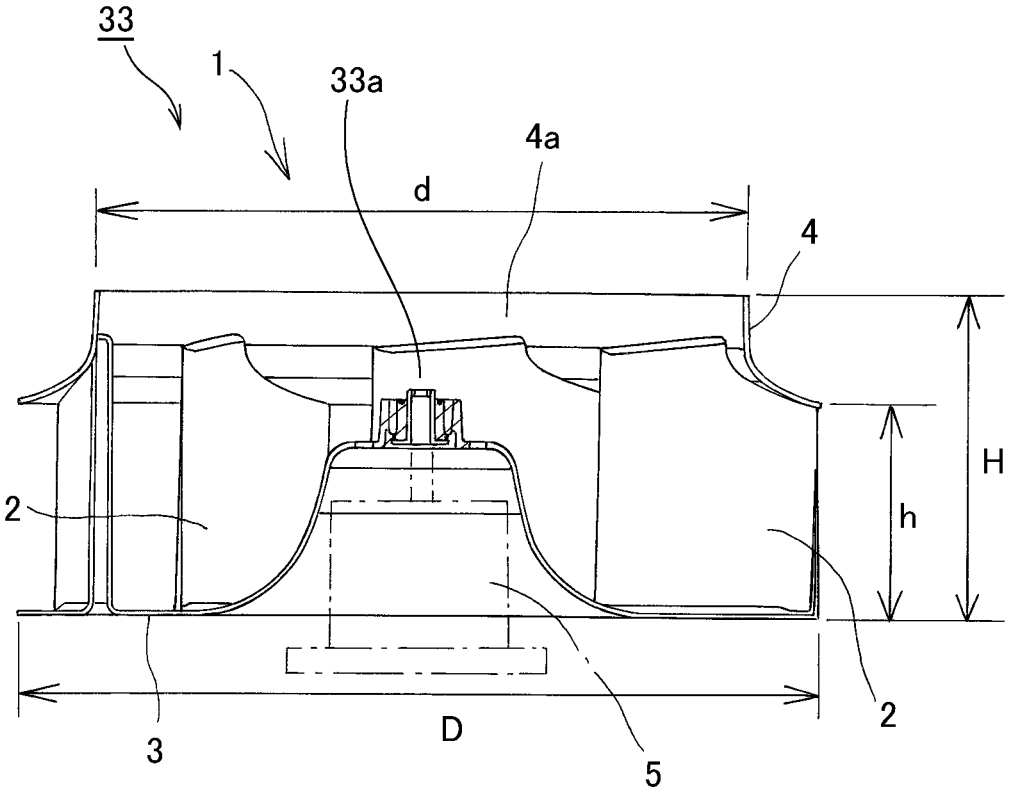
[FIG. 4] is a cross-sectional view of II-II of FIG. 1.

In FIG. 3 and FIG. 4, 1 represents the impeller, and the impeller 1 has plural vanes 2, a main plate 3 to which the vanes 2 are fixed, and a side plate 4 which is fixed to the end faces of the vanes 2 at the opposite side to the main plate and has a suction port 4*a*. In FIG. 4, 5 represents a motor which is directly connected to the impeller 1, and the motor 5 is fixed to a casing (not shown) in which the motor 5 and the impeller 1 are mounted. When the motor 5 is driven, the impeller 1 of the centrifugal air blower 33 is rotated, and air sucked from the air suction port 4*a* is blown out sideward by a centrifugal force.

The inventors have introduced shape factors of the air blower for satisfying both enhancement of the airflow amount of the centrifugal air blower 33 and reduction of the load of the motor 5 simultaneously through a simulation. In FIG. 4, first, when the height H of the air suction port, the height h of the air blow-out port, the diameter D of the impeller 1 and the diameter d of the air suction port 4*a* are set as parameters, the inventors have found how the variation of these shape factors act on the enhancement of the airflow amount of the centrifugal air blower 33 and the reduction of the load of the motor 5.

Figure 5:
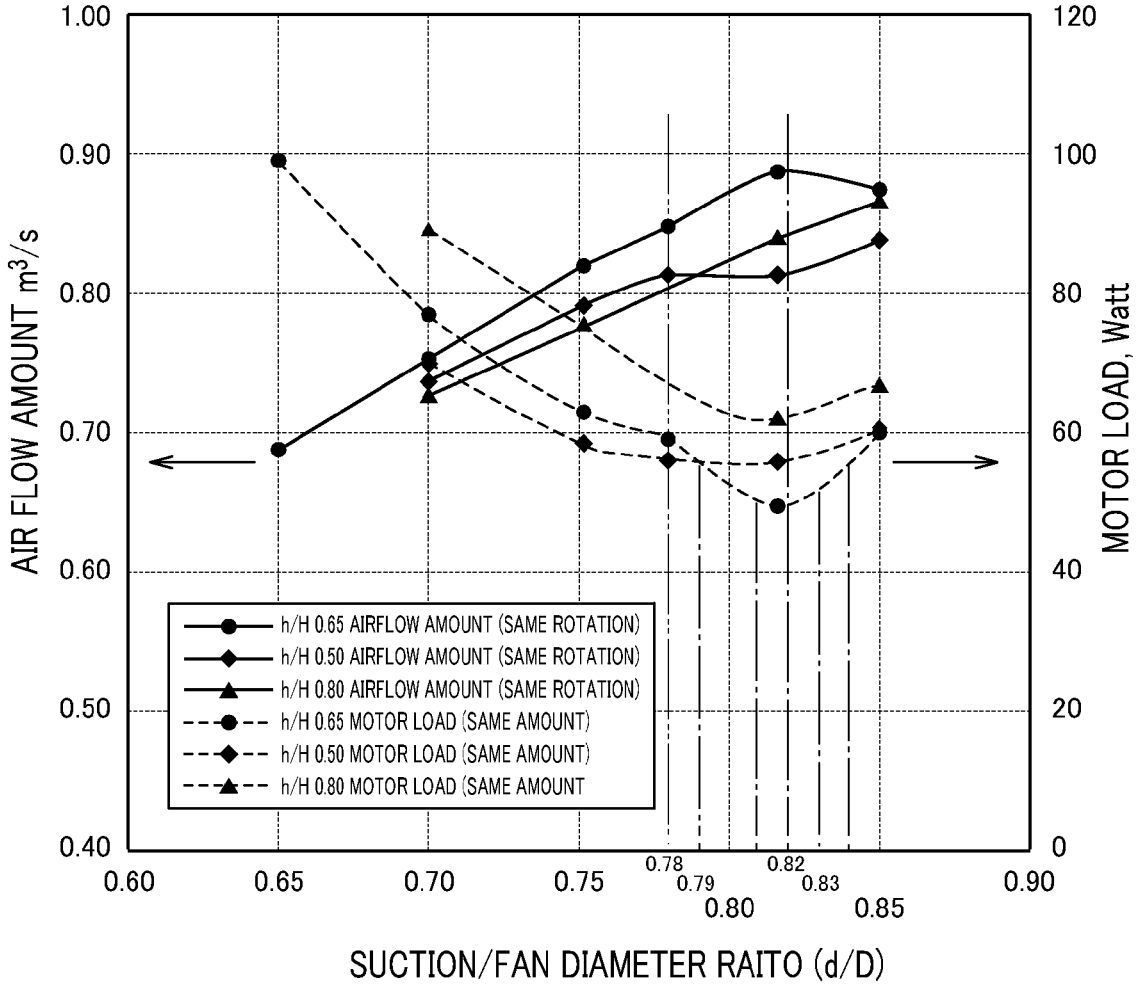
[FIG. 5] is a diagram showing the relationship of a suction fan diameter ratio, an airflow amount and a motor load.

FIG. 5 shows the suction/fan diameter ratio (d/D) on the abscissa axis, the airflow amount (Q)$m^3$/s on the ordinate axis at the left side and the motor load Watt on the ordinate axis at the right side. In FIG. 5, diamonds represent an air blower of h/H=0.50, circles represent an air blower of h/H=0.65, and triangles represent an air blower of h/H=0.80. According to this simulation, it has been found that the air blower which is designed in the neighborhood of h/H=0.65 (sign of circle) and d/D=0.82 brings the largest airflow amount (Q)$m^3$/s and the smallest motor load Watt, thereby achieving the highest performance.

Here, when specifically reviewing the airflow amount (Q)$m^3$/s of the centrifugal air blower 33, for all the air blowers satisfying 0.50<h/H<0.80, the airflow amount trends to increase as a whole until d/D reaches 0.78.

For the air blower of h/H=0.65 (sign of circle), the airflow amount increases from d/D=0.78 till d/D=0.82, and it turns into decrease when d/D exceeds 0.82. Furthermore, for the air blower of h/H=0.50 (sign of diamond) when d/D exceeds 0.78, the airflow amount is substantially fixed until d/D increases to 0.82. When d/D exceeds 0.82 again, the airflow amount turns into increase again. For the air blower of h/H=0.80 (triangle sign), even when d/D exceeds 0.78, the increasing trend of the airflow amount continues until h/H reaches 0.85.

Therefore, d/D is limited to the range of 0.78<d/D<0.85, and data (solid line) of h/H=0.55 (sign of x), h/H=0.60 (rectangle sign) and h/H=0.70 (sign of x+vertical line) are further added in addition to h/H=0. 5 (sign of diamond), h/H=0.65 (sign of circle) and h/H=0.8 (triangle sign) described above, and the resultant data are shown in FIG. 6.

When the trend of the three added data is further analyzed, for the air blowers of h/H=0.55 (sign of x) and h/H=0.70 (sign of x+vertical line), the trend of increase continues until d/D=0.85 even when d/D exceeds 0.78. Furthermore, for the air blower of h/H=0.60 (rectangle sign), the airflow amount increases from d/D=0.78 to d/D=0.82, and it neither increases nor decreases when d/D exceeds 0.82.

Figure 6:
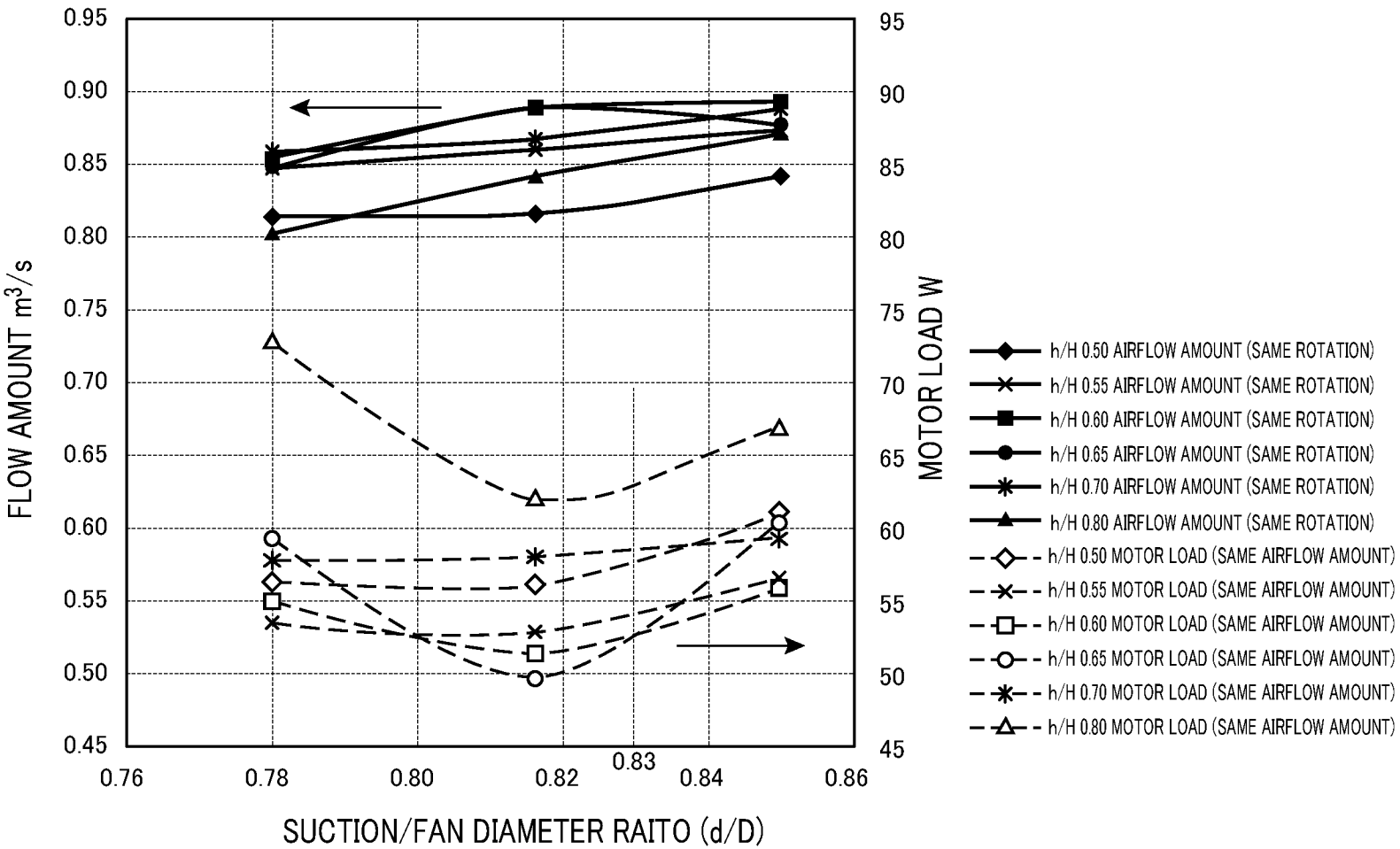
[FIG. 6] is a diagram showing the relationship of the suction fan diameter ratio, the air flow amount and the motor load.

As a result, in the range of 0.78<d/D<0.85 shown in the abscissa axis direction of FIG. 6, the air blower designed under h/H=0.65 (sign of circle) keeps a high airflow amount, and the airflow amount becomes small even when h/H is smaller or larger than 0.65.

Furthermore, when the motor load Watt of the centrifugal air blower 3 is reviewed, in the range of 0.65<d/D<0.85 shown in the abscissa axis direction of FIG. 5, for h/H=0.5 (sign of diamond), h/H=0.65 (sign of circle) and h/H=0.8 (sign of triangle), the motor load Watt gradually decreases as a whole, and for h/H=0.65 (sign of circle), a local minimum value appears in the neighborhood of d/D=0.82.

Therefore, the range of d/D is limited to 0.78<d/D<0.85, and data (broken line) of h/H=0.55 (sign of x), h/H=0.60 (rectangle sign) and h/H=0.70 (sign of x+vertical line) are further added in addition to h/H=0.5 (sign of diamond), h/H=0.65 (sign of circle) and h/H=0.8 (triangle sign) described above, and the resultant data are shown in FIG. 6.

When the trend is further analyzed while containing the added three data, the air blower of h/H=0.55 (sign of x) has the lowest motor load Watt from d/D=0.78 till d/D=0.80, and has higher values for other values of d/D. However, the air blower of h/H=0.65 (sign of circle) has the lowest motor load Watt from d/D=0.80 till d/D=0.83.

Regarding the motor load Watt, it has been found that 0.78<d/D<0.85 or 0.79<d/D<0.84 is preferable, and 0.80<d/D<0.83 is further preferable.

From this simulation, in order to reduce the motor load Watt while keeping the airflow amount (Q)$m^3$/s of the centrifugal air blower 33 to a high value, it has been found that the design based on h/H=0.6 (sign of circle) and 0.80<d/D<0.83 is desired.

As described above, it has been found that the enhancement of the airflow amount (Q)$m^3$/s and the reduction of the motor load Watt can be simultaneously satisfied when the centrifugal air blower 33 of this embodiment is designed under the condition of 0.5<h/H<0.8 and 0.78<d/D<0.85. More preferably, it has been also found that the motor load Watt can be further reduced when the air blower is designed under the condition of h/H=0.65 and 0.80<d/D<0.83.

Figure 7:
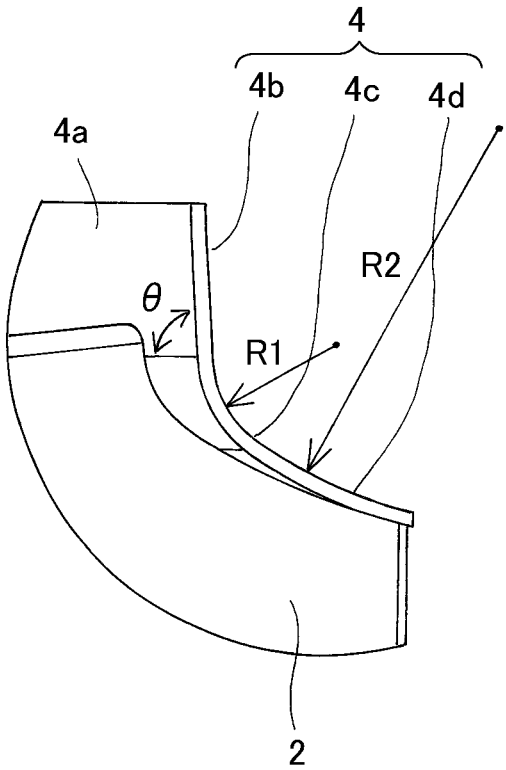
[FIG. 7] is an enlarged cross-sectional view of a side plate.

FIG. 7 is an enlarged view of a side plate (shroud) 4 of the centrifugal air blower 33 shown in FIG. 4.

The side plate 4 of this centrifugal air blower 33 comprises a suction portion 4*b* extending substantially linearly, a first curved line portion 4*c* intercommunicating with the suction portion 4*b* and a second curved line portion 4*d* intercommunicating with the first curved line portion 4*c*. The radius of curvature R1 of the first curved line portion 4*c* and the radius of curvature R2 of the second curved line portion 4*d* have the relationship of R1<R2, and also in this air blower, the impeller 2 extends beyond the first curved line portion 4*c* inside the side plate 4 and reaches the suction portion 4*b* as shown in FIG. 4.

The radius of curvature R1 and the radius of curvature R2 are set as parameters, and it has been found how the variation of these shape values contribute to the enhancement of the airflow amount (Q)$m^3$/s of the centrifugal air blower 33 and the reduction of the load Watt of the motor 5.

Figure 8:
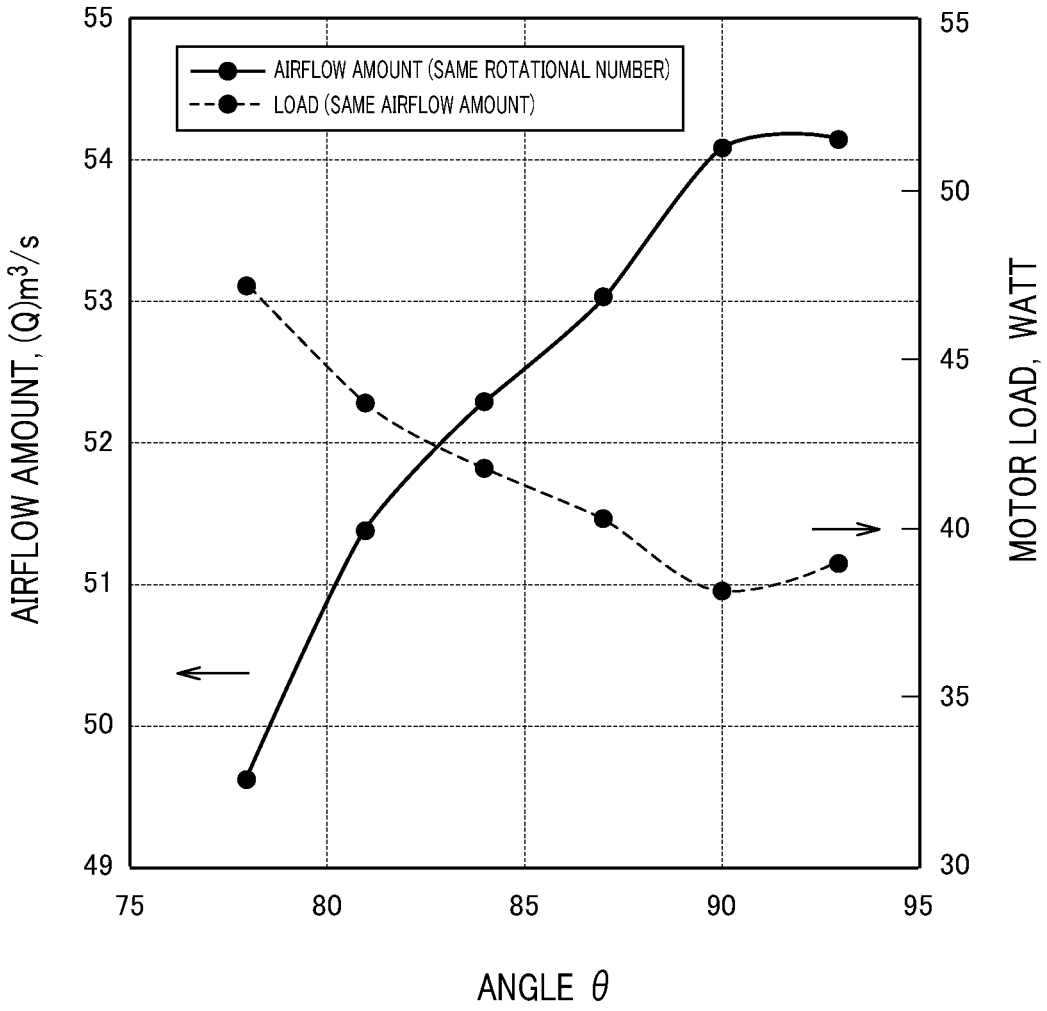
[FIG. 8] is a diagram showing the relationship of an angle of the side plate, the airflow amount and the motor load.
Figure 9:
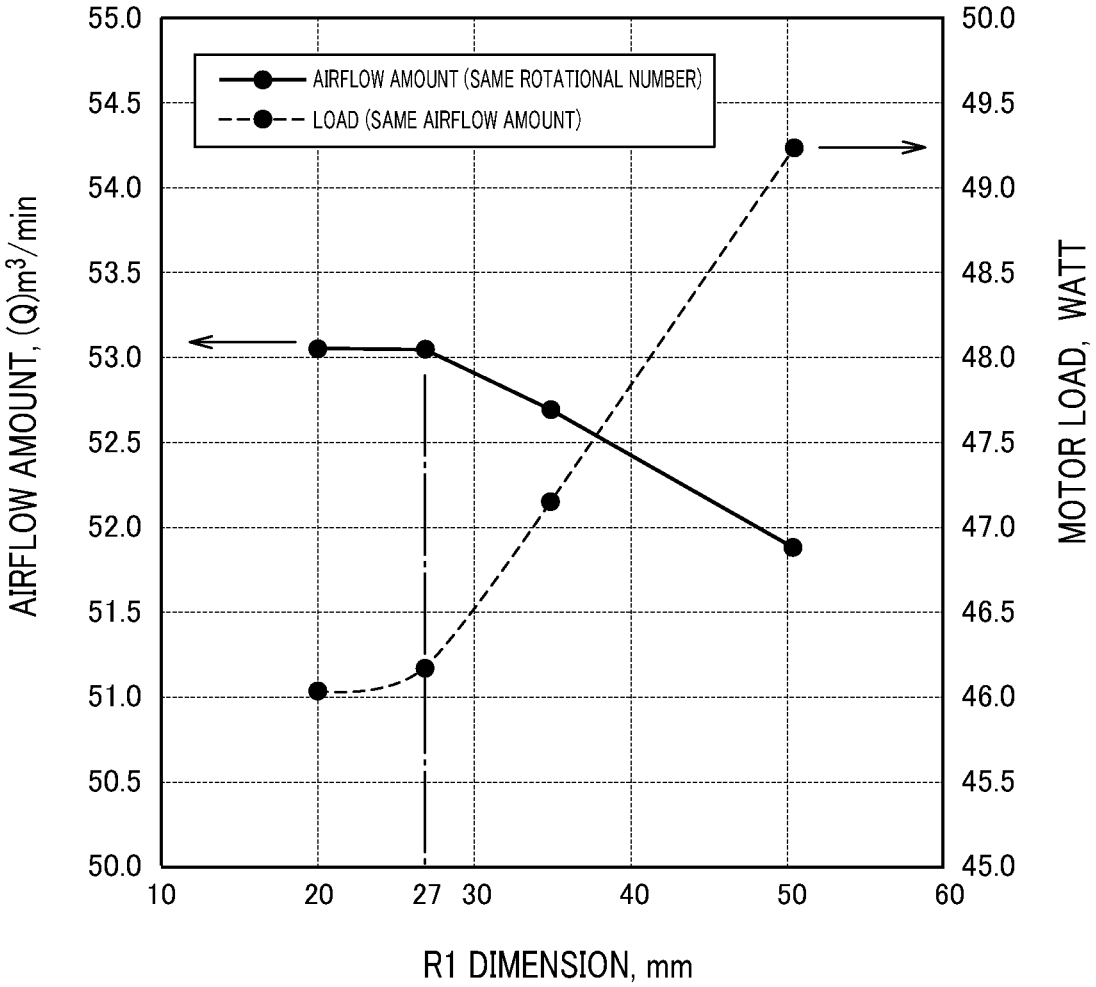
[FIG. 9] is a diagram showing the relationship of a radius of curvature R1, the airflow amount and the motor load.
Figure 10:
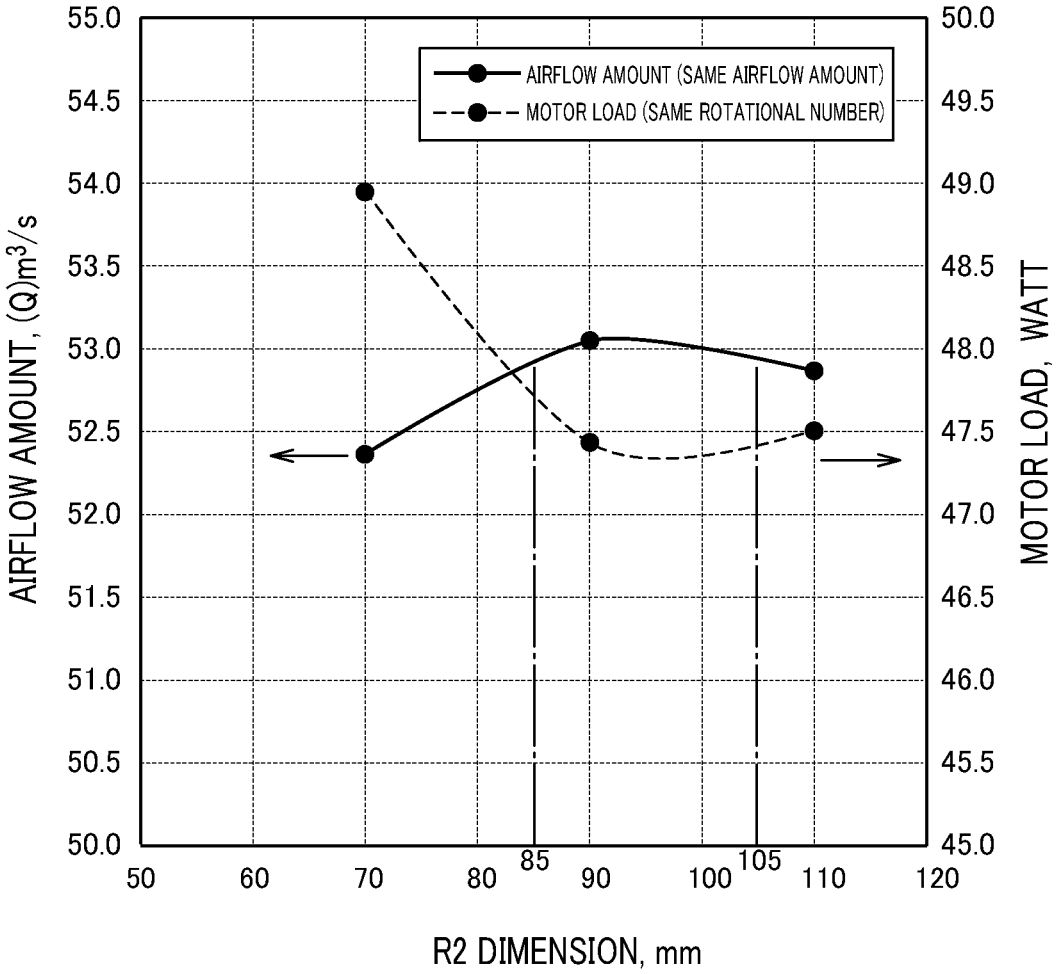
[FIG. 10] is a diagram showing the relationship of a radius of curvature R2, the airflow amount and the motor load.

FIG. 8 shows the relationship of the angle of the suction portion 4*b*, the airflow amount (Q) $m^3$/s and the motor load Watt, FIG. 9 shows the relationship of the radius of curvature R1 of the first curved line portion 4*c*, the airflow amount (Q)$m^3$/s and the motor load Watt, and FIG. 10 shows the relationship of the radius of curvature R2 of the second curved line portion 4*d*, the airflow amount (Q)$m^3$/s and the motor load Watt.

First, as shown in FIG. 8, when the angle of the suction portion 4*b* increases, the motor load Watt decreases. When the angle approaches 90, the motor load Watt is equal to a minimum value. On the other hand, when the angle of the suction portion 4*b* increases, the airflow amount (Q)$m^3$/s increases, and when the angle reaches 90, no variation is observed after that.

Accordingly, according to a simulation result, it is desired that the angle of the suction portion 4*b* of the side plate 4 approaches to 90.

Regarding the radius of curvature R1 of the first curved line portion 4*c*, it has been found that the enhancement of the airflow amount (Q)$m^3$/s and the reduction of the motor load Watt can be performed in the range of 20 mm<R1<27 mm as shown in FIG. 9. When the radius of curvature R1 exceeds 27 mm, the airflow amount (Q)$m^3$/s shifts to decrease, and the motor load Watt shifts to increase.

Accordingly, according to a simulation result, it is desired that the air blower is designed on the condition of 20 mm<R1<27 mm for the radius of curvature R1.

As shown in FIG. 10, regarding the radius of curvature R2 of the second curved line portion 4*d*, it has been found that a local maximum value appears at R2=90 mm.

The airflow amount (Q)$m^3$/s trends to increase until R2=90 mm. When R2 exceeds 90 mm, the airflow amount (Q)$m^3$/s shifts to moderate decrease. On the other hand, the motor load Watt trends to decrease until R2=90 mm, however, when R2 exceeds 90 mm, the motor load Watt shifts to moderate increase.

Accordingly, according to a simulation result, the air blower is designed so as to satisfy 85 mm<R2<110 mm for the radius of curvature R2, and preferably 90 mm<R2<105 mm.

As described above, according to the centrifugal air blower of this embodiment, when the angle of the suction portion 4*b* of the side plate 4 is made to approach to 90, the radius of curvature R of the first curved line portion 4*c* is set to satisfy 20 mm<R1<27 mm, and the radius of curvature R2 of the second curved line portion 4*d* is set to satisfy 85 mm<R2<110 mm, preferably 90 mm<R2<105 mm, whereby the enhancement of the air flow amount (Q)$m^3$/s and the reduction of the motor load Watt can be simultaneously satisfied.

Description of Reference Numerals

1 impeller
2 vanes
3 main plate
4 side plate
5 motor
10 indoor unit (air conditioner)
20 apparatus main body
21 housing
30 heat insulating material
33 air blower
50 ventilation duct
55 duct joint part
100 face panel
110 suction port
111 suction grille
120 air blow-out port

The invention claimed is:

1. A centrifugal air blower having an impeller comprising a main plate and a plurality of vanes, and a side plate having a suction port and a blow-out port, wherein the side plate has a suction portion extending substantially linearly, a first curved line portion intercommunicating with the suction portion, and a second curved line portion intercommunicating with the first curved line portion, the impeller extends beyond the first curved line portion inside the side plate and reaches the suction portion allowing at least one portion of each vane to be inside the suction port, and a radius of curvature R1 of the first curved line portion of the side plate satisfies 20 mm<R1<27 mm, and a radius of curvature R2 of the second curved line portion of the side plate satisfies 85 mm<R2<110 mm, and an end portion of the second curved line portion of the side plate is fixed to end faces of the vanes at an opposite side to the main plate, the vanes being gradually separated against the side plate from the second curved line portion to the first curved line portion and to the suction portion.

2. The centrifugal air blower according to claim 1, wherein $0.5<h/H<0.8$ and $0.78<d/D<0.84$ are satisfied in which "H" represents a height of the suction port, "h" represents a height of the blow-out port, "D" represents a diameter of the impeller, and "d" represents a diameter of the suction port.

3. The centrifugal air blower according to claim 2, wherein the diameter D of the impeller and the diameter d of the suction port satisfy $0.80<d/D<0.83$.

4. The centrifugal air blower according to claim 1, wherein an angle θ of the suction portion of the side plate is substantially equal to 90°.

5. An air conditioner comprising the centrifugal air blower according to claim 1, wherein the centrifugal air blower is provided in a box-shaped housing, and the air conditioner is further equipped with a heat exchanger.

* * * * *